United States Patent [19]

Koszewa et al.

[11] 4,321,575

[45] Mar. 23, 1982

[54] FUSE CUT-OUT RECLOSER APPARATUS

[75] Inventors: Bernhard Koszewa, Menomonee Falls; Arthur L. Thomas, Milwaukee, both of Wis.

[73] Assignee: Milwaukee Safety Devices, Inc., Menomonee Falls, Wis.

[21] Appl. No.: 155,099

[22] Filed: Jun. 2, 1980

[51] Int. Cl.[3] ..... B25B 11/00

[52] U.S. Cl. ..... 337/168; 81/3.8; 337/202; 337/211

[58] Field of Search ..... 337/208, 194, 211, 795, 337/213–215, 202, 203, 168, 171, 174, 175, 207; 81/3.8; 294/19 R

[56] References Cited

U.S. PATENT DOCUMENTS

| | | | |
|---|---|---|---|
| 1,430,053 | 9/1922 | Bush | 294/19 R |
| 1,667,332 | 4/1928 | Stahler | 81/3.8 |
| 1,704,491 | 3/1929 | Thompson | 81/3.8 |
| 2,024,744 | 12/1935 | Rawlins | 337/214 |
| 2,816,985 | 12/1957 | Lindell | 337/202 |
| 3,026,391 | 3/1962 | Bridges et al. | 294/19 R |
| 4,045,762 | 8/1977 | Foulkes | 337/401 |

*Primary Examiner*—William H. Beha, Jr.
*Attorney, Agent, or Firm*—Andrus, Sceales, Starke & Sawall

[57] ABSTRACT

A fuse recloser for placing a fuse in a vertically oriented fuse holder includes a channel-shaped fuse shoe pivotally mounted within a channel-shaped support. The side arms of the shoe and support flex and the shoe releasably grips a fuse. The exterior of the fuse shoe includes cam surfaces which engage with the outer ends of the support which serve to collapse the shoe onto the fuse while permitting a forced release of the fuse shoe from the support. A release lever is provided for initial separation of the fuse shoe and support, after which the shoe is readily removed from the fuse. A U-shaped handle extends from the support outwardly and then rearwardly in offset relation to the support. A flexible line is secured to the outer end of the offset handle member with a fuse in the shoe and the shoe within the support. The one end of the fuse is placed in lower pivotal mount on the fuse holder and depends downwardly therefrom with the offset handle member extending upwardly. The lineman demounts from the pole, moves from the base of the pole and then pulls on the end of the line to snap the fuse into place. The lineman may then return to the fuse location, and use a switch pole to activate the release lever to release the shoe from the support and then remove the recloser from the fuse by pivoting the recloser on the upper end of the fuse holder.

13 Claims, 10 Drawing Figures

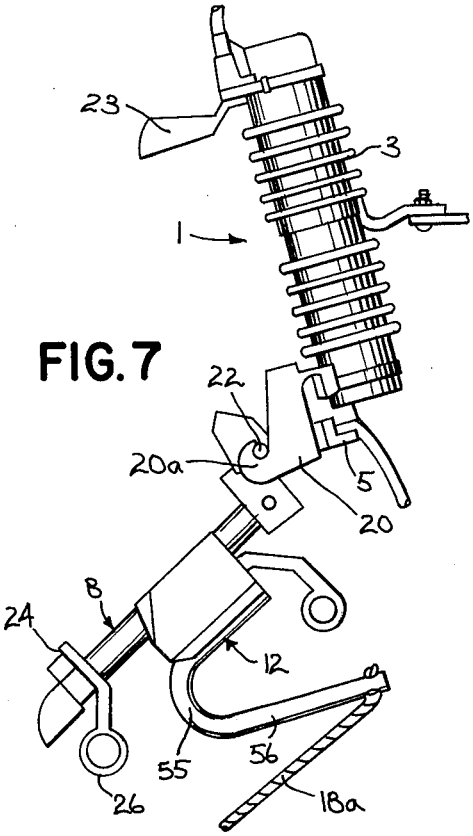
FIG. 7
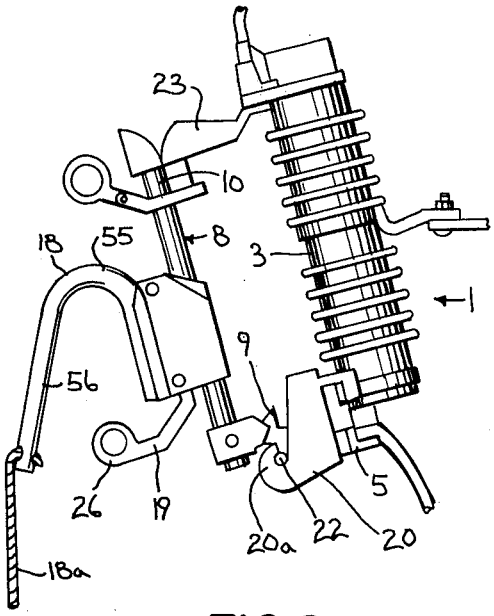
FIG. 8
FIG. 9
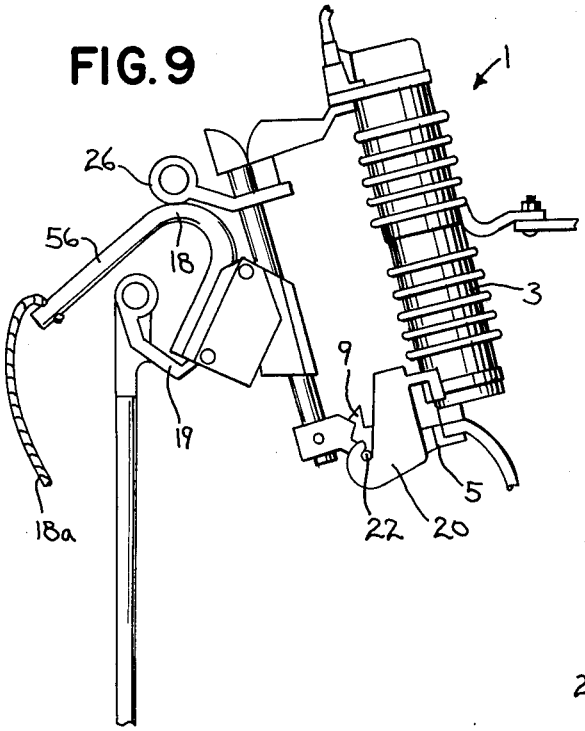
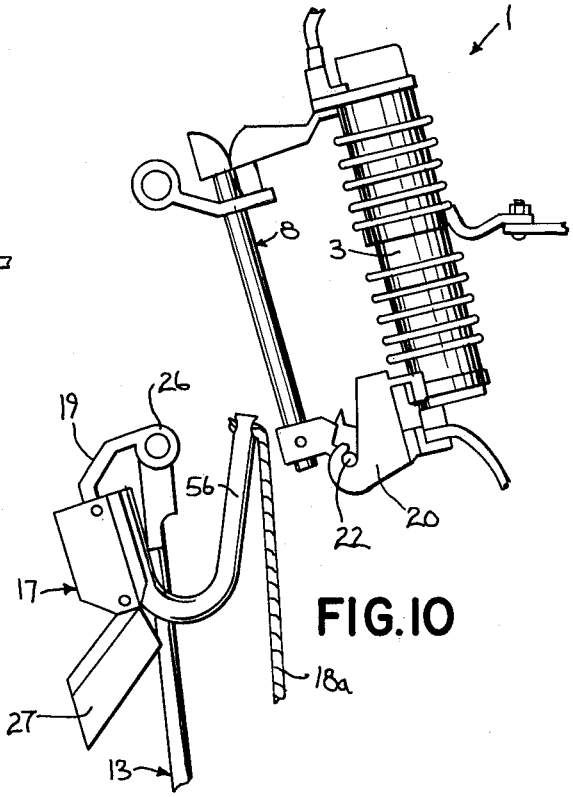
FIG. 10

FUSE CUT-OUT RECLOSER APPARATUS

BACKGROUND OF THE PRESENT INVENTION

This invention relates to a power fuse recloser apparatus and particularly to such a recloser having a remote mechanical operator which permits the workmen to remove themselves from the possible hazard area during reclosing of a power line fuse.

Power distribution systems employ various fuse structures for opening a circuit in response to abnormal and/or particularly dangerous power conditions. Fuse cutout structures are widely used in the service lines in power distribution and function to burn open and stop current flow in response to abnormal power line conditions, which are primarily predetermined overvoltage conditions. Such conditions are often caused by falling tree branches during a wind storm, lightening striking the lines or equipment, animals crossing the lines and various other abnormal conditions. The fuse cutout structures are generally constructed to release and drop from the fuse support or holder such that the lineman can readily locate the blown fuse. A widely employed fuse cutout structure includes a tubular cartridge fuse which is replaceably mounted within a pole or transformer mounted fuse holder. The fuse is specially constructed to open extremely rapidly to protect the power system components and the equipment connected to the power system, and in fact the fuse may open with an explosive characteristic. The fuse structures are generally formed with an outer insulating tubular shell with a fuse mechanism secured within the insulating shell and terminating at the opposite end in electrical contacts. The fuse holder includes an insulating support with end fuse contacts and connector members for connection to the line. The connector members are coupled to the opposite end fuse contacts to establish the electrical path between the power leads. Generally, the lower fuse contact is pivotally mounted in the lower connector of the fuse holder while the upper fuse contact includes a releasable latch mechanism to firmly support the fuse cartridge in place. When the fuse burns open, the entire assembly is released and drops under the force of gravity to an obvious and notable open position. The latch mechanism usually includes a release lever at the upper end for opening and closing the latch mechanism and thereby providing removal and insertion of the fuse through the use of a conventional switch pole. The latch structure is employed with a hook or switch pole to permit the linemen to effect the closing without actually engaging the fuse structure. The switch stick includes fuse support hooks secured to an insulating handle to isolate the workmen from the high power line connections to which the fuse cartridge is inserted. The fuse is generally constructed such that during the fuse opening, the gases generated within the fuse blow out the upper end of the tubular fuse cartridge. As a practical matter, the fuse may at times explode, disrupt the cartridge and even escape through the opposite or lower end of the fuse.

Under normal operating conditions, the linemen or other workmen can safely climb the pole and open or close the fuse. However, in new installations or once a fuse has blown, there is always the danger that during the fuse replacement an abnormal condition exists, may not have cleared itself or more than one abnormal condition may have existed and not all of them been located and cleared.

A particular occasion for creation of a hazardous condition in power line systems is an over-voltage line condition which is applied on a pole-mounted transformer or capacitor banks. For example, an over-voltage line condition may result in faulting a winding in an adjacent pole-mounted power transformer of the oil-filled type. Just before or just after the fuse senses an over-voltage line condition and before the fuse burns opens, such line condition may fault the transformer winding. The lineman cannot visually detect such fault. He must however mount the pole to replace the fuse and even though a fuse stick is used, the linesman is in a hazarad area. Thus, upon reclosure of the fuse, an arc is created at the fault point in the winding and thus within the insulating oil. Such arc produces an instantaneous energy release which may equal 25,000 B.T.U.'s per pound of oil. The result is often a large fireball reaching 25 to 20 feet down the pole and enveloping the power, wires, the cutout and other adjacent elements including linemen.

Although the hook pole and switch stick structures thus are widely employed and provide some degree of safety, the explosive characteristic of power line fuse reclosure is such that a severe hazard to the workmen is an ever present unknown danger. Thus, injuries and even deaths have been reported resulting from malfunctions during a fuse reclosing on a power line.

There is therefore a need for a remote recloser unit which will not only permit but preferably require the lineman to reclose the fuse from a relatively remote location so as to be located in a safe working distance, both horizontally and vertically, from the potentially explosive equipment. Such a device would provide a significant improved safety for linemen and others engaged in installing and servicing new and existing equipment and particularly servicing existing equipment which has been either taken out of service or blown a fuse as a result of line equipment malfunction and the like.

SUMMARY OF THE PRESENT INVENTION

The present invention is particularly directed to a portable cut-out fuse recloser unit which can be releasably coupled to a fuse with the one end pivotally mounted in one end of a fuse holder and then actuated from a safe working distance in all directions from the fuse mechansim to insert the fuse into the fuse holder. Generally, in accordance with the teaching of the present invention, the fuse cut-out recloser means includes a split support means adapted to releasably grasp the fuse. The support means is provided with an offset handle structure and an elongated flexible actuator fuse support and handle. The structure is arranged and constructed such that with the fuse pivotally attached to one end of the fuse holder, movement of the flexible member pivots the fuse and fuse support about the pivotal mount to rapidly, fully drive the fuse into releasable latched engagement within the fuse holder. This permits the effective reclosing with the workmen at a totally safe distance from the fuse mechanism. The recloser unit is in accordance with a particularly unique feature and teaching for an optimum construction, constructed with appropriate angular orientation and mass centers which require that the lineman must be on the ground or at least spaced horizontally from the pole in order to execute the reclosing of the fuse cutout.

After complete reclosing, such that the linemen or other personnel can be assured that the equipment or system is properly operating, a release mechanism is operated to remove the recloser unit from the inserted fuse cartridge. The recloser unit also provides a special release means interconnected to the support and conjointly operable with the reinstalled fuse assembly to separate the recloser from the installed fuse cartridge without loading or stressing the fuse latch mechanism to ensure the positive release of the reclosure from the fuse cartridge without danger of removing the fuse cartridge from the fuse holder.

More particularly, in accordance with a particularly unique and practical embodiment of the present invention, the fuse recloser unit includes a generally channel-shaped base support with a substantially channel-shaped fuse shoe pivotally mounted within the support. The fuse shoe includes a pair of flexible side arms defining an internal opening for releasably gripping the fuse. The exterior of the sidearms of the fuse shoe include cam surfaces adapted to cooperate with the end portions of the fuse support to collapse the shoe onto the fuse cartridge while permitting a forced release of the fuse shoe from the support. A cammed lever is provided for initiating the release of the fuse shoe, after which the shoe is readily removed from the fuse. An offset handle member extends from one end of the support outwardly and then rearwardly in offset relation to the support. A flexible line is secured to the outer end of the offset handle member. With a fuse in the shoe and the shoe within the support, the one end of the fuse is placed in the pivotal mount on the fuse holder and depends downwardly therefrom with the offset handle member extending upwardly. The line is then "thrown" in the direction it will be pulled. The linemen then removes himself from the pole to the end of the flexible line and pulls on the line to snap the fuse into place. The lineman may be working from an aerial lift device or other such means or location and similarly snap the line therefrom, but in any event in spaced relation to the hazard area. The lineman may then proceed to the fuse location, and use the switch pole to release the shoe from the support and then the recloser from the fuse. The construction and arrangement of the recloser unit is preferably such that the recloser unit will not allow reclosing if the lineman snaps on the line, while still on the pole, and as previously noted, preferably even if snapped on the ground when located within the possible hazard area adjacent the pole.

The present invention has been found to provide a reliable, safe recloser which can be readily used by linemen and the like. The structure of the recloser is readily produced from commercially available material and with known forming and construction technique.

DESCRIPTION OF THE DRAWING FIGURES

The drawings furnished herewith illustrate a preferred construction of the present invention in which the above advantages and features are clearly disclosed as well as others which will be readily understood from the following description.

In the drawings:

FIGS. 7–10 are a series of elevational views illustrating the use of the recloser to place a fuse into a fuse holder.

DESCRIPTION OF ILLUSTRATED EMBODIMENT

Figure 1:
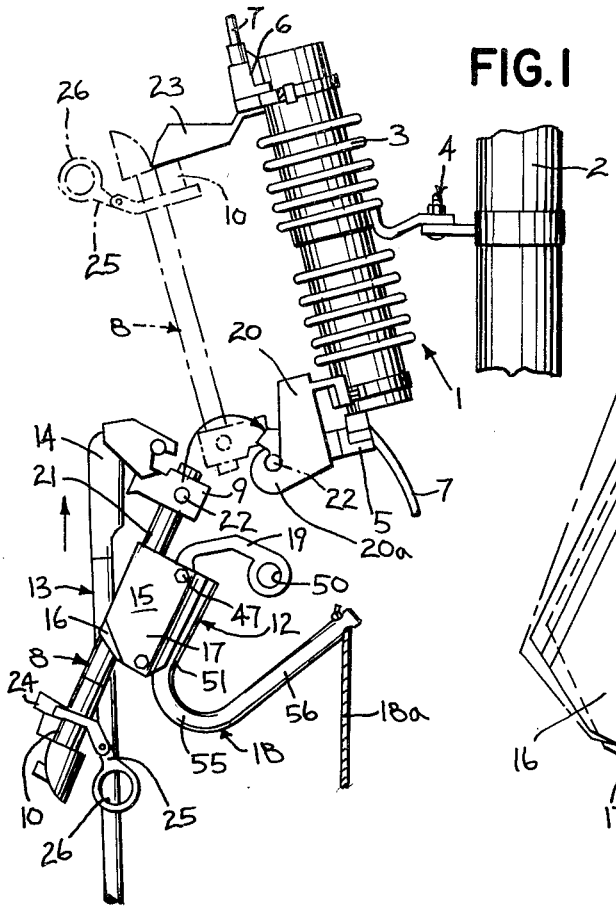
FIG. 1 is a side elevational view of a pole-mounted power line fuse holder with a fuse shown in a fuse recloser for insertion into the fuse holder.

Referring to the drawings and particularly FIGS. 1–6, a fuse holder unit 1 is shown mounted on a power line pole 2 or other power line equipment. The fuse holder unit 1 includes an insulating support 3 which is firmly secured to pole 2 by a support bracket 4. Line terminals or connectors 5 and 6 are secured to the opposite ends of the insulating support 3. Power line leads 7 are connected to the opposite end connectors of the fuse holder unit 1. A cartridge-type fuse 8 is releasably secured to the fuse holder unit 1 and includes a first fuse terminal 9 pivotally mounted to the lower connector 5 and a second fuse terminal 10 releasably latched to the second connector 6. The fuse terminals 9 and 10 are releasably connected to the corresponding connectors 5 and 6 and in accordance with the present invention, cartridge fuse 8 is to be inserted into connectors 5 and 6 by specially constructed fuse recloser unit 12. A conventional switch stick 13 may be provided with suitable end bracket 14 to support a fuse unit 8 releasably mounted in recloser unit 12. The recloser 12 includes a unit 15 which includes a fuse shoe 16 pivotally mounted within a clamp support 17. The fuse cartridge 8 is clamped within the fuse shoe 16 adjacent the lower fuse connector or terminal 9. The recloser 12 includes a generally U-shaped handle 18 which is secured to the support 17 and extends outwardly and rearwardly to locate the outer end in spaced relation to the support unit 15. An elongated flexible member such as a rope or line **18*a*, is secured to the outer end of the handle 18. In use, the unit 8 is inserted in the recloser 12 and the assembly hung from the lower pivotal connector 5. The operator thus moves to the other end of the line 18*a*, and thus is in safe spaced relation from the fuse holder unit 1 and adjacent equipment being energized, and therefore from the hazardous areas. The operator then pulls sharply on the line 18*a* which causes the recloser 12 and fuse unit 8 to pivot and establish a complete circuit as hereinafter described. The support unit further includes a release lever 19 to initially assist in separation of the fuse shoe 16 from the support 17 during removal of the recloser 12 from a reinserted fuse unit 8. Thus, once the fuse unit has been reclosed, the operator can safely return to the area of the fuse holder to remove the recloser. The release lever 19 may be actuated by switch stick 13 to release the fuse shoe 16 and then the recloser from the fuse unit 8**.

The present invention is particularly directed to the fuse recloser which may be used with the various conventional cartridge fuses and holders presently in use in the United States and elsewhere as well as any other construction by suitable modification to the recloser. The illustrated fuse holder 1 and the interconnected fuse connection is therefore only described herein to the extent necessary to clearly describe the structure and operation of the illustrated embodiment of the present invention.

More particularly, the lower fuse connector of the fuse holder includes a pivot bracket 20 formed with the line terminal 5 which is connected to the outgoing power line 7. The pivot bracket 20 is a bifurcated member having a pair of spaced pivot hooks or bearings 20*a* which open upwardly. The fuse lower contact 9 which is secured to the lower end of the tubular cartridge or housing 21 of the fuse provides electrical connection to an internal fuse element, not shown. The lower contact 9 includes a pivot pin 22 extending to the opposite sides of the contact and is adapted to be mounted within the fuse pivot bracket 20. The contact 9 is constructed such that with the fuse 8 pivoted to the closed position, the contact 9 projects inwardly into firm, positive engagement with the line connected terminal 5 of the fuse holder 1. The pivot hooks 20*a* prevent lateral movement of the fuse 8 and positively lock the lower end of fuse 8 within the holder 1. The upper fuse connector 10 is a conventional latch type having an upper latch bracket 23 with line terminal 6 secured thereto and adapted to receive the upper fuse terminal or contact 10 to releasably lock the upper end of fuse 8 within holder 1. The cartridge fuse unit 8 spans the brackets 20 and 23 and provides a fused electrical connection between the power lines 7.

Thus, the upper end of the fuse unit includes any suitable or well known contact 10 secured to the upper end of the fuse housing 21 and connected to the fuse element, not shown. The upper contact 10 includes a latch element 24 which is adapted to move into latching engagement within the bracket 23 to latch the fuse in the fuse holder 1. The upper fuse connector 10 also includes an eye-hook release lever 25 which is connected to the latch bracket for manual release of the fuse 8. The release lever 25 is shown projecting outwardly of brackets 24 and 23 with a hook portion 26 located for manual release and opening of the fuse holder.

The present invention as previously noted, is particularly directed to the fuse recloser 12, and the preferred embodiment for the conventional cartridge type assembly is shown and now described in detail.

Referring particularly to FIGS. 2–6, the fuse shoe 16 is a substantially channel-shaped member having a pair of similar sidewalls 27 and 28 connected to a base 29. The fuse shoe 16 is preferably an integral molded plastic member, as shown in the drawings. Although the shoe 16 as well as the several other components may be formed of any suitable material, the inventor has found that a particularly satisfactory material is a polymer such as ultra high molecular weight polyethylene. Such material has the necessary physical and electrical properties for use in power line systems environment. Further, the material may be conveniently molded to form the shoe and other components. A pivot pin opening 30 is provided in the base 29. In the assembled relation, the base is mounted on a pivot pin 31 to establish a pivotal connection of the shoe 16 to the support 17. The illustrated pivot pin 31 is a suitable vibration proof bolt and nut assembly. In addition to providing a stable, reliable connection, the recloser could be adjusted for a different diameter fuse barrel should the industry standard be changed at some future time. The interior surfaces on the outer ends of the sidewalls 27–28 are shaped with recesses 33 of a constant radius generally defining a circular opening complementing the outer diameter of the tubular cartridge 21 of fuse 8. The outermost ends of the sidewalls define a fuse opening and are formed as smooth curved ends 33*a* to permit the convenient insertion and removal of the fuse housing 21 through such opening.

Longitudinal slots 34 are preferably provided on each of the inner recesses 33. Similar clamping or gripping elements 35 are secured one each within the recesses 34. The elements 35 may be elongated strip members which are larger than and resiliently secured in the recesses 33 and project outwardly slightly to engage the side of the fuse tube 21. The elements 35 are formed of a suitable friction material to minimize the longitudinal movement of the fuse 8 within the shoe 16 with the sidearms or sidewalls flexed toward each other.

The connection of the sidewalls 27–28 to the base are formed with relatively thin spring portions 36 which produce the necessary degree of flexibility for insertion and removal of the fuse cartridge. The arms 27 and 28 flex outwardly to enlarge the entrance opening during cartridge insertion and removal. The shoe is preferably formed of a plastic material, having a low friction characteristic to permit forced movement into and from the channel-shaped support 17.

The outer surfaces of the sidewalls are similarly shaped to define inclined cam walls including a relatively long inner cam wall 37 and a shorter outer cam wall 38. The inner cam wall 37 extends laterally outwardly from the base 30 to about the center of the clamping recess to define an inclined cam. The outer cam wall 38 extends laterally inwardly from the first or inner cam wall 37 at a rather sharp angle and then outwardly at a lesser angle adjacent the outer end of the arm 27 to define a holding notch or recess. The cam wall structure provides for the releasable connection of the fuse shoe 16 within the base support 17 and permits pivotal insertion and removal movement of the fuse shoe 16 with the fuse 8 within the shoe 16.

Thus, the base support 17 is generally a channel-shaped member having a base portion 40 with a pair of sidewalls 41 and 42 extending outwardly. The width and depth of the opening of base support 17 generally complements the outer configuration of the shoe 16 and is slightly greater than the shoe, which is pivotally mounted therein. A pin opening 43 is provided in the sidewalls of the base support 17 immediately outwardly from the base 40 and is adapted to receive the pivot pin 31 extending through the openings 43 and the aligned opening 30 in the base of shoe 16. The sidewalls 41 and 42 are secured to the base 40 by the reduced portions, generally shown as internally removed corner connections 44 and 45 which define spring connections which also permit lateral deflection of the sidewalls 41 and 42 of the support 17.

The spacing of sidewalls 41 and 42 define an opening slightly larger than that of the shoe 16. The outer ends of the support sidewalls 41 and 42 project inwardly to define latch fingers 46 which extend laterally toward each other. The fingers 46 define an opening of a diameter which is slightly less than spacing of the outer cam walls 37 and 38 of the sidewalls 27 and 28 of the fuse shoe 16, including the outermost lesser angled portion of the outer cam wall 37. The fingers 46 are generally triangularly shaped with smooth, rounded outer ends and an inner cam surface at 46*a*, as illustrated most clearly in FIG. 6. Thus, with the fuse shoe 16 located within the support 17, the shoe 16 is firmly but releasably held in position by the fingers 46 being resiliently held on the shoe cam wall 38 as a result of the flexible structure of the support sidewalls. The engagement of the cam wall 38 and the corresponding inclined cam surface of the latch fingers 46 permit a forced outward pivotal movement of the shoe 16 within the base support 17 with the sidewalls 41 and 42 of the support deflecting outwardly to allow the fuse shoe 16 to move outwardly of the support 17. Similarly, the inner cam wall 37 permit the forced pivotal inward movement of the shoe 16 into the latched position. After the shoe 16 moves outwardly from the closed position, the cam wall 37 with the reducing width toward the base, also supports the movement of the shoe from the support.

Figure 3:
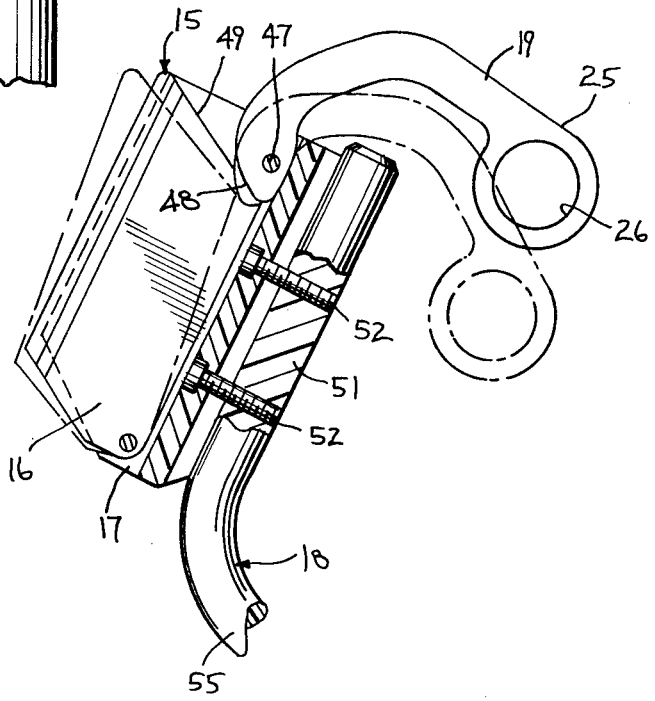
FIG. 3 is a small view of the recloser with parts broken away and sectioned.
Figure 4:
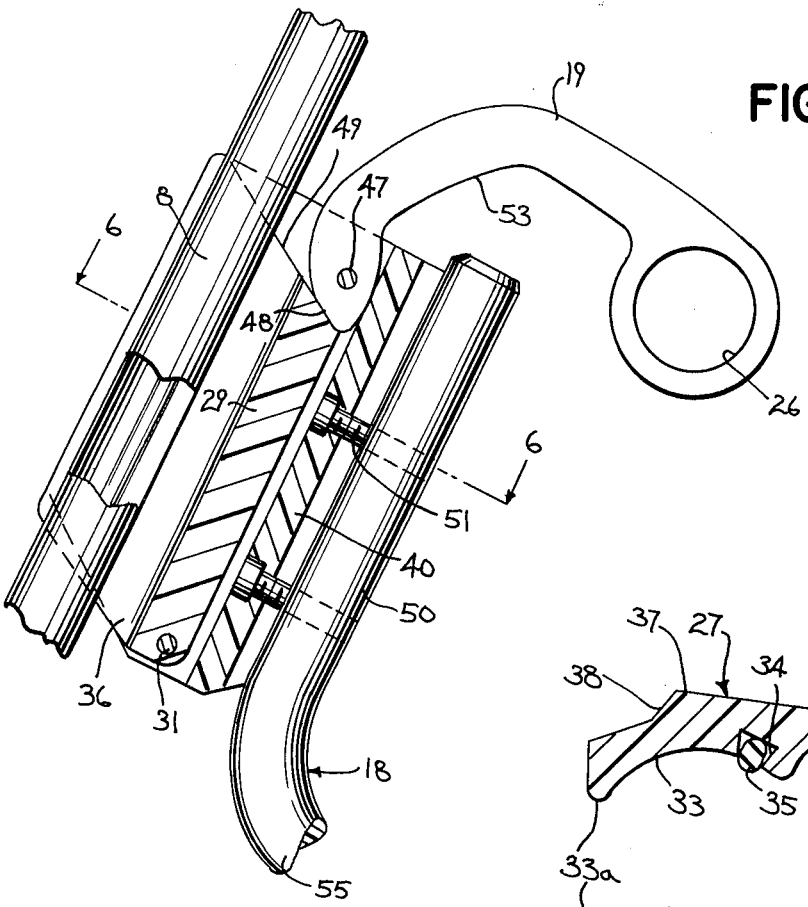
FIG. 4 is a view shown similar to FIG. 3 with a fuse in the recloser.
Figure 5:
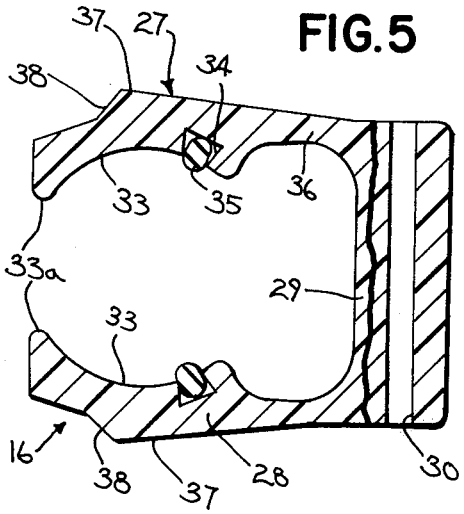
FIG. 5 is a transverse section through a fuse show shown in FIGS. 1–4.
Figure 6:
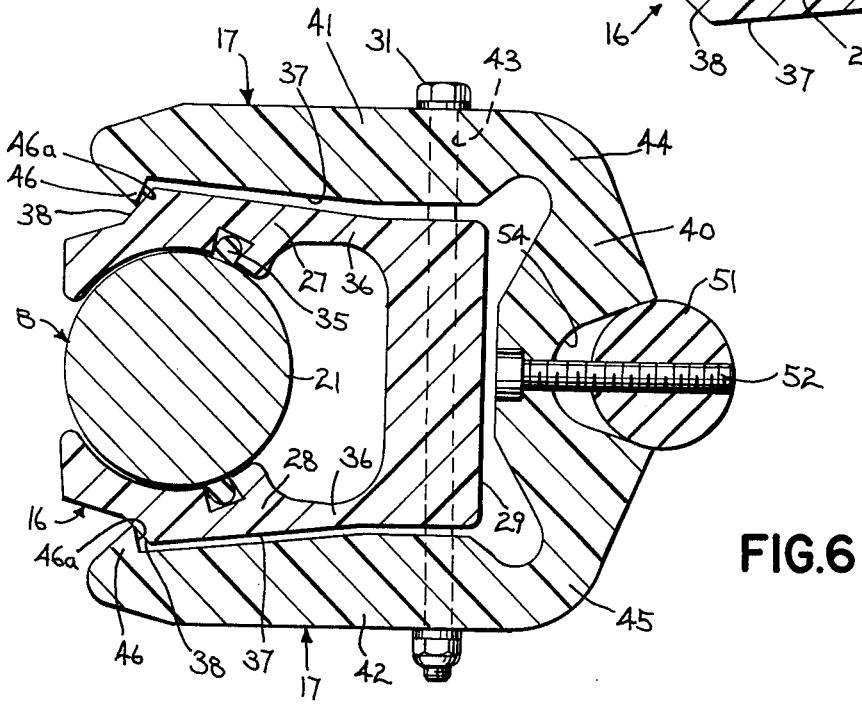
FIG. 6 is a transverse section taken generally on line 6—6 of FIG. 4.

The pivotally mounted shoe 16 is slightly shorter in length than the base support 17 to accommodate a pivotal mounting of the release lever 19 to the support 17 adjacent the outer free end of the shoe 16, as shown in FIGS. 3 and 4. The lever 19 is pivotally mounted to the support sidewalls 41 and 42 as by a pivot pin 47. The inner end of the lever 19 is provided with a generally spiral cam surface 48 which rotates within the support 17 toward shoe 16 in response to forced pivotal movement of the lever 19. The free end of the shoe 16 is formed as inclined wall 49 to define a second cam element aligned with and engaging the spiral cam surface. The lever 19 is a short, curved arm which curves outwardly from the support and backwardly slightly behind the base thereof and thus partially into the inverted handle. The outer end lever 19 includes a conventional eye-hook 26 for manipulation thereof with a switch stick. The pivotal movement of the lever 19 thus forces the shoe 16 outwardly with sufficient force to deflex the support latch fingers 46 on the cam walls 37 and with continued movement of lever 19 the shoe moves sufficiently to locate the outermost surfaces of the cam walls 37 between the finger 46. The fingers 46 then move onto the release cam wall 37. This releases the latched position of the shoe 16 and provides for ready removal of the shoe 16 from within the support 17, even with the cartridge fuse 8 within the shoe 16 which prevents inward collapse of the shoe sidewalls.

The handle 18 is a generally U-shaped member. The one leg 51 is firmly fixed to the exterior side of the support base 40 of support 17 as by suitable attachment screws 52. The outermost end of leg 51 is a flat wall located immediately outwardly of the support 17 and in the path of the release lever 19. The aligned portion of lever 19 is also flat wall 53 which moves into engagement with the end of leg 51, which thus serves as a limit or stop for the travel of cam 19 and thereafter transmits the force on cam 19 to the support 17. The arrangement and construction is of course such that the shoe is released from support 17 when the cam lever 19 has moved to the above limit position.

The leg 51 of handle 18 is secured with a nonconcentric fit into a recess or slot 54 in the base 40. This permits the adjustment of the attachment if necessary to compensate for wear, wearing or the like as the result of use and thereby extend the useful life of the recloser. The leg 51 extends outwardly of the support 17 to a curved or bent junction 55 to an outer leg 56 which extends backwardly at an outward angle to the first leg 51. The angle orientation of the outer arm 56 provides optimum movement of the recloser unit 12 during the reclosing movement, as presently described.

Figure 2:
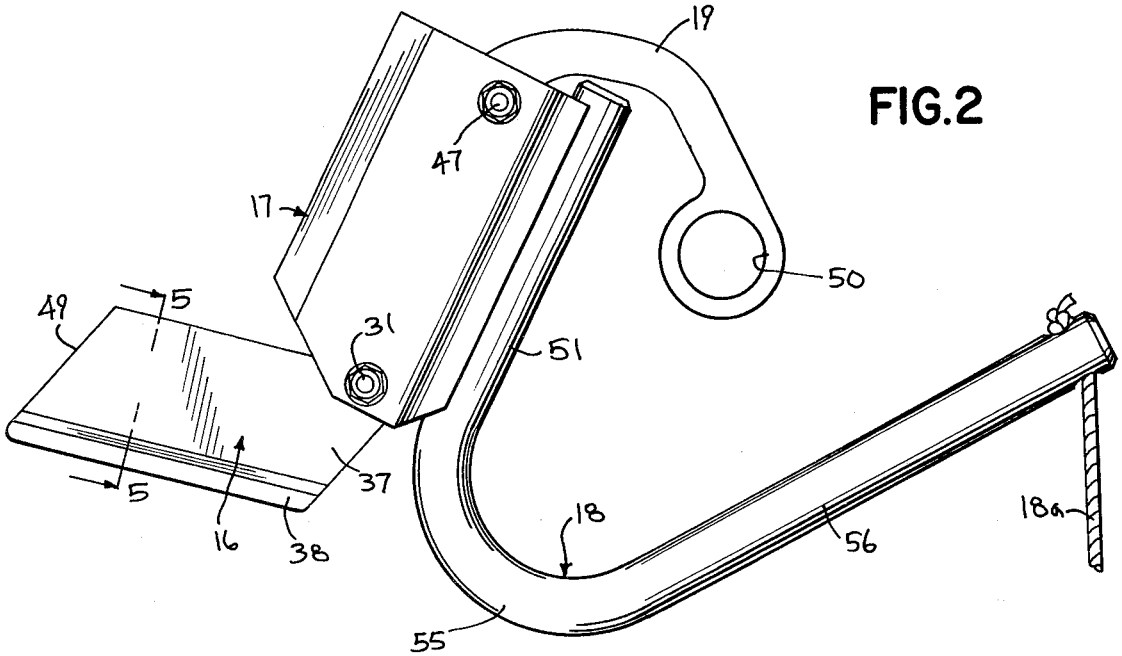
FIG. 2 is an enlarged elevational view of the reclosure shown in FIG. 1.

Referring particularly to FIGS. 1, 2 and 7–10, inclusive, the lineman places the fuse 8 within shoe 16 in the open position of support unit 15, as shown in FIG. 2. The shoe 16 is then closed into clamp support 17, with finger 46 of support 17 moving into the cam wall 38 to latch the recloser in the closed position, shown in FIGS. 4 and 6. The lineman places the assembly onto bracket 14 of switch stick 13 and inserts the fuse 8 into bracket 20, with pivot pins 22 located in place and within the support hook portions **20*a*. The switch stick is removed, allowing the assembly to hang downwardly from pins 22. The U-shaped handle 18 opens upwardly, as shown in FIG. 1. The line 18*a* is released, and the lineman moves to the outermost end of line 18*a* which permits location in both horizontal and vertical spacing from the fuse 8** a sufficient distance to avoid any hazard, should a transformer or capacitor bank blow up upon reclosing.

The lineman positions himself with respect to the recloser 12 such that pulling on line **18*a* causes the recloser 12 to pivot outwardly about the bracket 20. The lineman is generally located to align line 18*a* with the handle 18. However, the lineman may be located 15 degrees to either side of such position with the illustrated embodiment. The lineman thus pulls rapidly with a short snap action, such as with a flick of the wrist, on the outer end of line 18*a* in the direction which causes the recloser 12 to pivot rapidly with a snap action movement which forces the fuse 8 to move into the fuse holder 1. In particular, the lower contact 9 moves into contact 5 and the upper contact 10 moves into bracket 23 with bracket 24 moved into latched engagement with the bracket 23, as shown in FIG. 8. Thus, the orientation of the leg 52 is such that pulling of the leg to the inverted position as shown in FIG. 8, requires the movement of opposite leg support unit 15 and fuse 8 into proper alignment to force the fuse 8 into place. The circuit is again completed. If a fault should exist, the fuse 8 of course ruptures to again open the line. However, the lineman is safely removed from the exploding transformer or capacitor bank and thus the hazard area. If the line is functioning properly, the lineman remounts the pole and inserts a pin of the switch pole 13 into the eye-hook of the latch lever 19 and pushes upwardly thereon. The pivotal movement of lever 19 and the cam end 48 forces the inclined end 49 of shoe 16 outwardly relative to support 17, causing the support 17 to pivot outwardly of the shoe 16 and fuse 8, thereby releasing the firm holding force of the shoe 16 on the support 17. The lineman continues upward movement on lever 19 which forces the support 17 from shoe 16, and may move the recloser upwardly on fuse 8 with the curved junction portion permitted to move into engagement with the underside of the latch release lever 25, as shown in FIG. 9. Continued upward force on the switch stick 13, pivots the support 17 and handle 18 about the outer end of the lever 25. The shoe coupling pin 31 moves outwardly and pulls the shoe 16 off the tube of fuse 8, and thereby releasing the recloser 12 from fuse 8. The engagement with lever 25 is such as to positively hold the upper latch contact end of fuse 8 in holder 1 in place. The pivot pin connection at pin 22 positively holds the lower contact end of fuse 8 in place. Thus, there is no danger that the fuse 8** will be dislodged during the removal of the recloser.

The fuse recloser thus permits reclosing from the ground and at a safe distance from the potentially hazardous transformer and the like. Thus, as shown, the recloser cannot be effectively operated to close the fuse from the pole. Further, with the illustrated angular orientation and the mass center location, the lineman must move outwardly from the base of the pole. The unit is also conveniently used in residential city areas when the electric pole may be closely adjacent a garage, house or other structure. The lineman may, while on the pole, readily determine the most advantageous closer operating location. The lineman then takes the line, wraps it into tied throw bundle and tosses the bundle toward the selected operating location. The illustrated embodiment is particularly constructed to permit an impatient jamming application of the hot stick to the recloser unit during removal which may arise particularly during adverse weather conditions. The cam lever is specially formed with an angled leg with the flatted portion 53 located to approach the flatted base of the linehook and clamp part. This will prevent breaking of the cam lever as a result of the abuse that may result in the force multiplicity from the pivot point to the cam loop. The special formed radius in the handle to define a rolling fulcrum ensures that even during a jamming motion on the lever, a literal camming action is created to remove the closer unit off the fuse and fuse holder. Thus, if lineman inserts the hot stick and applies a rapid punch motion on the hot stick, the fuse recloser unit may slide a part of the way up the fuse barrel. In all instances, the curved or bent portion engages the top portion of the fuse holder and acts as a rolling fulcrum, literally camming the recloser unit from the fuse and fuse holder.

The present invention thus provides a significant improvement in the field of hazardous circuit recloser for power distribution systems and the like.

Various modes in carrying out the invention are contemplated as being within the scope of the following claims, particularly pointing out and distinctly claiming the subject matter which is regarded as the invention.

We claim:

1. A fuse recloser apparatus for inserting a fuse having spaced circuit contacts for connection in a power unit and having a releasable pivotal mount within a fuse holder, said power circuit being subject to creation of hazardous condition upon insertion of said fuse and creating a hazard area adjacent the fuse holder, comprising a fuse shoe unit having clamping means adapted to releasably grasp a fuse, a fuse support, means movably mounting said fuse shoe unit within said support for positioning said fuse shoe unit between a holding position and a release position, said support having means coupled with said clamping means to position the shoe unit in said holding position or said release position, an elongated actuator secured to said support and having an outer operating end adapted to be spaced from the support a distance in excess of the hazard area from the fuse holder, and pivotal mounting means for pivotally mounting of the fuse and fuse recloser to said fuse holder and responsive to movement of the actuator to pivot the fuse into the fuse holder.

2. The fuse recloser apparatus of claim 1 wherein said clamping means of said fuse shoe unit includes clamping jaws adapted to releasably grasp a fuse, said fuse shoe unit is pivotally mounted to said support, said support having means coupled with said jaws and biasing said jaws into clamping engagement in said holding position and spreading said jaws in said release position.

3. The recloser apparatus of claims 1 or 2 including a support handle secured to said support and having an outer leg spaced from said support, said elongated actuator being a flexible line secured to said outer leg.

4. The recloser apparatus of claim 3 wherein said outer leg is angularly oriented with respect to said support and said recloser apparatus is arranged and constructed such that said line must be actuated vertically and horizontally spaced from said pivotal mounting means to pivot the fuse into the fuse holder.

5. The recloser apparatus of claims 1 or 2 including a release lever means operable to separate said shoe unit from said holding position to said release position.

6. The recloser apparatus of claim 5 wherein said release lever means includes a hook receiving means for actuation of the lever means with a hook stick unit.

7. A power system fuse recloser apparatus for inserting a tubular fuse having end contacts in a vertically oriented fuse holder having vertically spaced upper and lower line terminals, said lower line terminal having a pivotal support means for pivotal support of said fuse within said lower terminal and preventing outward movement of the lower end of the fuse, comprising a fuse shoe having a generally channel-shaped configuration including spaced sidewalls, said sidewalls having opposed concave recesses on the outer interior end portion of the sidewalls to define an opening for receiving said tubular fuse between said end contacts, said sidewalls being flexible and having an unstressed position to grasp said fuse, a support having channel-shaped configuration defining a cavity generally complementing and slightly larger than the fuse shoe and having sidewalls, said sidewalls being flexible and having outer clamping end portions defining an opening less than the maximum width of the shoe, pivot means pivotally connecting the one end of said shoe within said support with said shoe extending therefrom to an outer free end, the exterior outer ends of said fuse shoe sidewalls and the interior outer ends of said support sidewalls including opposed cammed locking means for forced movement of said shoe into and from said support, cooperating cam means including a cam lever and cam wall on said support and said shoe in longitudinal spaced relation to the pivot support means and operable in response to movement of said cam lever to force separate said support and shoe, a handle secured to said support having an outwardly located leg extending backwardly and outwardly in spaced relation to said support, and a flexible line secured to the outermost end of said leg.

8. The recloser apparatus of claim 7 wherein said handle is a U-shaped handle having an inner leg secured to the support and connected by a curved connection to said outer leg proximate said pivotal support means of said cam means, said curved connection defining a rolling fulcrum support for said recloser in the removable of the recloser from the tubular fuse.

9. The fuse recloser apparatus of claims 7 or 8 wherein said cam lever is a curved member having a first end pivotally mounted within said channel-shaped support and includes a cam surface on the inner pivoted end and extending outwardly and about the proximate end of the support to an outer hook end, said fuse shoe having its free end inclined to form said cam wall located proximate said cam surface with the fuse shoe closed within the support, said lever moving said cam surface to engage the shoe and establish relative pivotally movement between the shoe and support.

10. The recloser apparatus of claim 9 wherein said cammed locking means includes an inclined cam recess on the exterior surface of the fuse shoe sidewalls and inwardly projecting locking fingers on the outer end portions of the support sidewalls.

11. The recloser apparatus of claim 10 wherein said exterior surface of the fuse shoe sidewalls includes a second cam surface extending inwardly from the transverse outer end portion of the cam recess to bias the fuse shoe from the support in response to movement of the shoe cam recess outwardly of the locking fingers.

12. The recloser of claim 8 wherein said inner leg is a cylindrical member, said support includes an elongated clamping slot with said leg located in the outer opening to said slot, and attachment bolt mean extending through the leg and support to firmly clamp the leg to the support.

13. The recloser of claim 7 wherein said recesses include inner longitudinal slots, and resilient friction elements located in said slots and protruding outwardly to engage the fuse.

* * * * *